US010100540B2

(12) United States Patent
Fügel et al.

(10) Patent No.: US 10,100,540 B2
(45) Date of Patent: Oct. 16, 2018

(54) BOOM FOR A WORKING MACHINE AND METHOD FOR PRODUCING SAME

(71) Applicant: Putzmeister Engineering GmbH, Aichtal (DE)

(72) Inventors: Dietmar Fügel, Wolfschlugen (DE); Christian Hahn, Schönaich (DE); Matthias Braun, Stuttgart (DE)

(73) Assignee: Putzmeister Engineering GmbH, Aichtal (DE)

( * ) Notice: Subject to any disclaimer, the term of this patent is extended or adjusted under 35 U.S.C. 154(b) by 0 days.

(21) Appl. No.: 15/605,726

(22) Filed: May 25, 2017

(65) Prior Publication Data

US 2017/0260761 A1 Sep. 14, 2017

Related U.S. Application Data

(63) Continuation of application No. PCT/EP2015/077764, filed on Nov. 26, 2015.

(30) Foreign Application Priority Data

Nov. 28, 2014 (DE) ..... 10 2014 224 462

(51) Int. Cl.
*E04G 21/04* (2006.01)
*B66C 23/00* (2006.01)
(Continued)

(52) U.S. Cl.
CPC ..... *E04G 21/0445* (2013.01); *B66C 23/54* (2013.01); *B66C 23/64* (2013.01); *E04G 21/0436* (2013.01); *E02F 3/382* (2013.01)

(58) Field of Classification Search
CPC . E04G 21/04; E04G 21/0445; E04G 21/0436; B66C 23/64; E02F 3/382;
(Continued)

(56) References Cited

U.S. PATENT DOCUMENTS 6,786,233 B1 * 9/2004 Anderson et al. ..... B66C 23/64 137/615
2004/0228739 A1 * 11/2004 Mayer et al. ..... E04G 21/04 417/231
2013/0078072 A1 3/2013 Yelistratov et al.

FOREIGN PATENT DOCUMENTS

CN 102493651 A 6/2012
CN 103015726 B 3/2013
(Continued)

OTHER PUBLICATIONS

Written Opinion of the International Searching Authority, PCT/EP2015/077764, dated Dec. 18, 2015.

*Primary Examiner* — Kevin Lee
(74) *Attorney, Agent, or Firm* — Bose McKinney & Evans LLP

(57) ABSTRACT

A boom for a working machine, in particular a concrete-distributing boom for guiding a concrete delivery line, with a plurality of boom arms which can be moved into a working position and which are composed at least partially as a box construction of a plurality of side walls delimiting a cavity region, and with a sealing bulkhead arrangement for sealing a cross section of the cavity region, wherein the sealing bulkhead arrangement has a bulkhead wall provided peripherally with an at least partially encircling sealing groove, and wherein the sealing groove has arranged therein an elastic seal which bears tightly on the inside against the adjoining side walls.

14 Claims, 2 Drawing Sheets

(51) Int. Cl.
*B66C 23/64* (2006.01)
*E02F 3/38* (2006.01)

(58) Field of Classification Search
CPC ..... E02F 3/38; F16L 13/12; F16L 25/0081; Y10T 137/8807
See application file for complete search history.

(56) References Cited

FOREIGN PATENT DOCUMENTS

| | | | |
|---|---|---|---|
| CN | 203947781 | U | 11/2014 |
| DE | 102010022947 | A1 | 12/2010 |
| DE | 102012224340 | A1 | 6/2014 |
| EP | 0838563 | A1 | 4/1998 |
| EP | 2256254 | A2 | 12/2010 |
| JP | S6294140 | U | 6/1987 |
| WO | WO 2013/078919 | A1 | 6/2013 |

* cited by examiner

BOOM FOR A WORKING MACHINE AND METHOD FOR PRODUCING SAME

RELATED APPLICATIONS

This application is a continuation of PCT/EP2015/077764, filed Nov. 26, 2015, which claims priority to DE 10 2014 224 462.5, filed Nov. 28, 2014, both of which are hereby incorporated herein by reference in their entireties.

BACKGROUND

The invention relates to a boom for a working machine, in particular a concrete distributing boom for guiding a concrete delivery line, comprising a plurality of boom arms, which are movable into a working position and which are composed at least partially, as a box construction, of a plurality of side walls delimiting a cavity region, and further comprising a sealing partition arrangement for sealing a cross section of the cavity region. The invention further relates to a method for producing such a boom.

On boom arms of concrete distributing booms, the respective pivot drive is connected in the articulation region. On the other hand, the arms must be interconnected. Both the one and the other require, in some cases, the opening of the box section support. In order to prevent water from penetrating into the cavity region of the arm, the openings are in practice closed off again with welded-in sealing partitions. In this construction, the regions to be sealed must be sufficiently accessible that the necessary weld seams can be made. Moreover, such weld seams can lead to undesirable notch effect in the components.

SUMMARY

Based on the above, this disclosure further improves the boom arms and boom production methods known in the prior art and provides, even in poorly accessible regions, a sealing which is simple and reliable from a production engineering aspect, and thus optimizes the boom design.

This disclosure is based on the notion of using, instead of an integrally bonded sealing by weld seams, a sealing profile. Accordingly, it is proposed according to this disclosure that the sealing partition arrangement has a partition wall, which is provided on its peripheral side with an at least partially, and preferably fully circumferential sealing groove, and that in the sealing groove is arranged an elastic seal, which bears in a sealtight manner against the inside of the adjacent side walls. By means of such a profiled seal extending in a groove-shaped seat, regions can also be sealed in which no welding can be carried out due to lack of space and/or because of the notching effect. The arm profile can thus be of more filigree design and does not for accessibility reasons have to be built larger, and thus heavier, than is actually necessary. Moreover, through the avoidance of adverse notch effect, the arm constructions, in which thicker plates or doublers were hitherto necessary, can be built lighter.

One advantageous embodiment provides that the seal is formed by a formless sealing compound, which has been introduced into the sealing groove and preferably consists of a polyurethane sealant. In this way, the seal is not damaged during welding works in the prefabrication, and a precise contour matching, with the compensation of tolerances, is enabled.

In order to integrate such a seal in a simple manner from a production engineering aspect, it is of advantage to provide a feed channel for the introduction of sealing compound into the sealing groove, which feed channel extends in a side wall, formed preferably by a chord, or in the partition wall.

Advantageously, the partition wall positioned in the cross section to be sealed is pre-fixed to at least one side wall, in a desired position, by an integrally bonded, positive or non-positive connection.

It is also favorable if the junction between the partition wall and a side wall (preferably a web) of the box section is arranged centrally in the side wall in the region of the neutral axis.

Advantageously, the partition wall is formed as an, in particular, quadrangular metal plate matched to the cross-sectional contour to be sealed. The use of plastics moldings as the partition wall is also conceivable.

In order to realize a circumferential groove in a simple manner, it is possible for the partition wall to be of multi-layered construction, wherein the lateral outer layers form the groove flanks of the sealing groove.

From a production engineering aspect, it is of advantage if the box section is formed of two mutually opposing webs, and two chords resting externally on the longitudinal edges of the webs. In such a design, hitherto welded-in partitions are provided in the articulation region, which partitions can be replaced in a notch-free manner by the solution according to this disclosure.

A particularly advantageous use is obtained by virtue of the fact that the sealing partition arrangement seals a hinge joint on the end portion of a boom arm against ingress of corrosive media.

The subject of this disclosure is a method for producing a boom for a working machine, in particular a concrete distributing boom for guiding a concrete delivery line, in which a plurality of boom arms are preferably articulately connected to one another, wherein the boom arms are composed at least partially, as a box section, of a plurality of side walls delimiting a cavity region, and in which a sealing partition arrangement is inserted into a cross section of the cavity region. In this context, it is proposed that a partition wall is provided on its peripheral side with an at least partially circumferential sealing groove, and that in the sealing groove is arranged a seal, which bears in a sealtight manner against the inside of the adjacent side walls. In terms of the method, the above described effects advantages of the analogous device features are achieved in the same way.

A preferred measure provides that the partition wall is pre-fixed in the cross section to be sealed, by welding or tacking, clamping, screwing, stops or grooves. Furthermore, it is advantageous if a formless sealing compound is introduced into the sealing groove and is cured therein with the formation of the seal. In this context, it is also favorable if the sealing groove is filled with a sealing compound via a feed channel in a side wall or in the partition wall, which feed channel is accessible from outside the boom arm.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
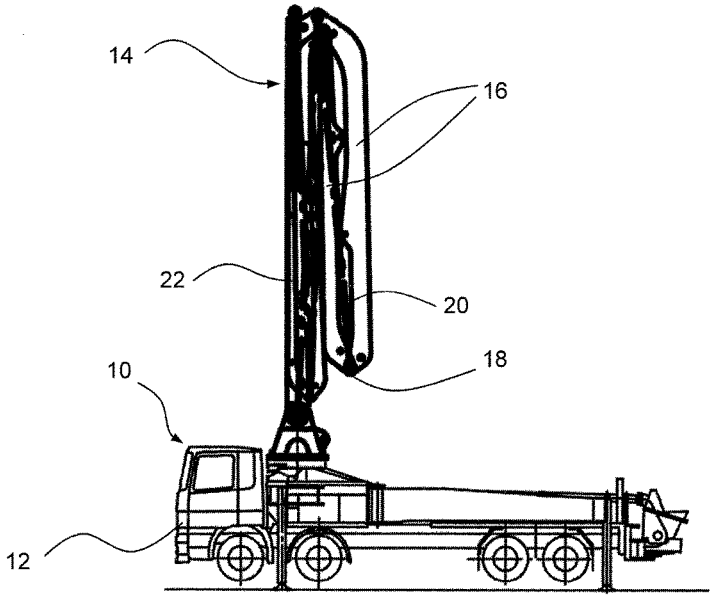
FIG. 1 shows a truck-mounted concrete pump having an unfoldable multiarmed concrete distributing boom in side view.

The truck-mounted concrete pump 10 shown in FIG. 1 comprises a road vehicle 12 and a concrete distributing boom 14, which is transportable thereon, having a plurality of boom arms 16, the latter of which are connected to one another via articulated joints 18 and are mutually pivotable by means of hydraulic pivot drives 20 on the articulated joints 18, so that a concrete delivery line 22 guided along the boom 14 is variably positionable with its end hose within a working range.

Figure 2:
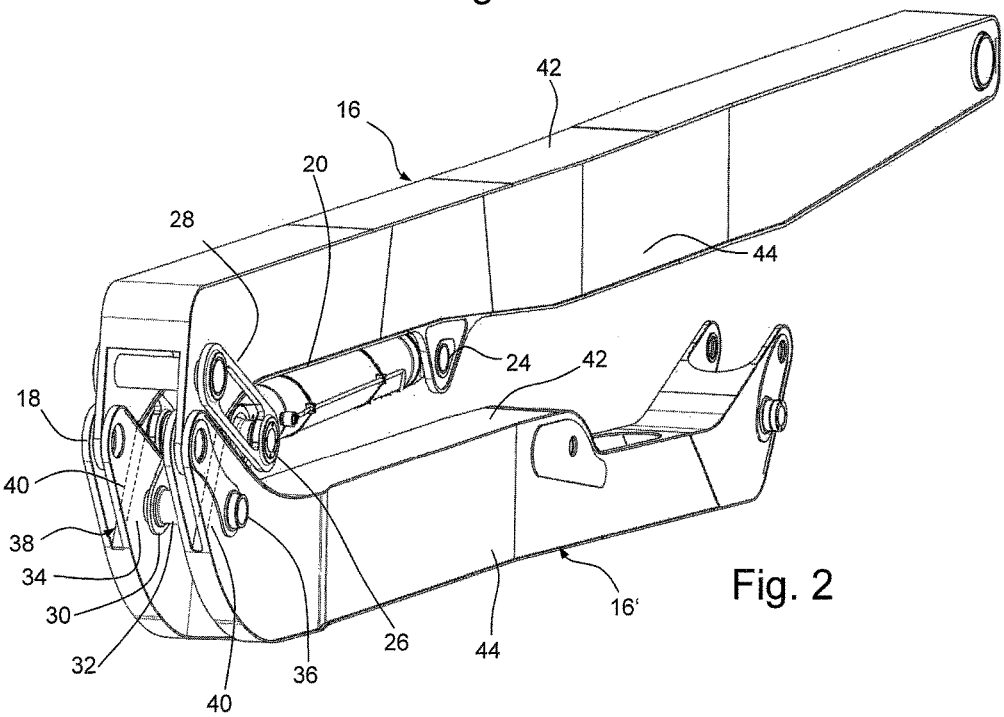
FIG. 2 shows two articulately connected boom arms of the concrete distributing boom with an inserted sealing partition arrangement, in perspective representation.

FIG. 2 shows two boom arms 16, 16' of the arm assembly according to FIG. 1, which at their cranked forked ends are articulately connected to one another via an articulated joint 18. In order to perform a pivot motion about the articulated joint 18, a hydraulic cylinder is provided as a pivot drive 20, which on the bottom side is attached via a hinge joint 24 to a boom arm 16 and which on the rod side, via a deflection linkage 26 close to the articulated joint 18, acts on both boom ends. Expediently, the deflection linkage 26 comprises a pair of deflection levers 28 acting externally on the boom arm end of one boom arm 16, and a pair of pressure rods 30 engaging in the open fork region of the other boom arm end. Said pressure rods are mounted on a hinge bolt 32, which forms a hinge joint 36 which penetrates the cavity region 34 at the fork ends of the boom arm 16'.

As a result of the inward displacement of the pressure rods 30 into the U-shaped clearance, the concrete delivery line 22 can be guided relatively closely past the boom arm 16' and the arm profile can be kept narrower in total, so that the two boom arms 16, 16' can be guided or deposited side by side at a short distance apart.

In order to prevent the penetration of corrosive media, in particular water, into the cavity region 34, a sealing partition arrangement 38, comprising two partition walls or partition plates 40, is provided, as this is described in greater detail further below.

Figure 3:
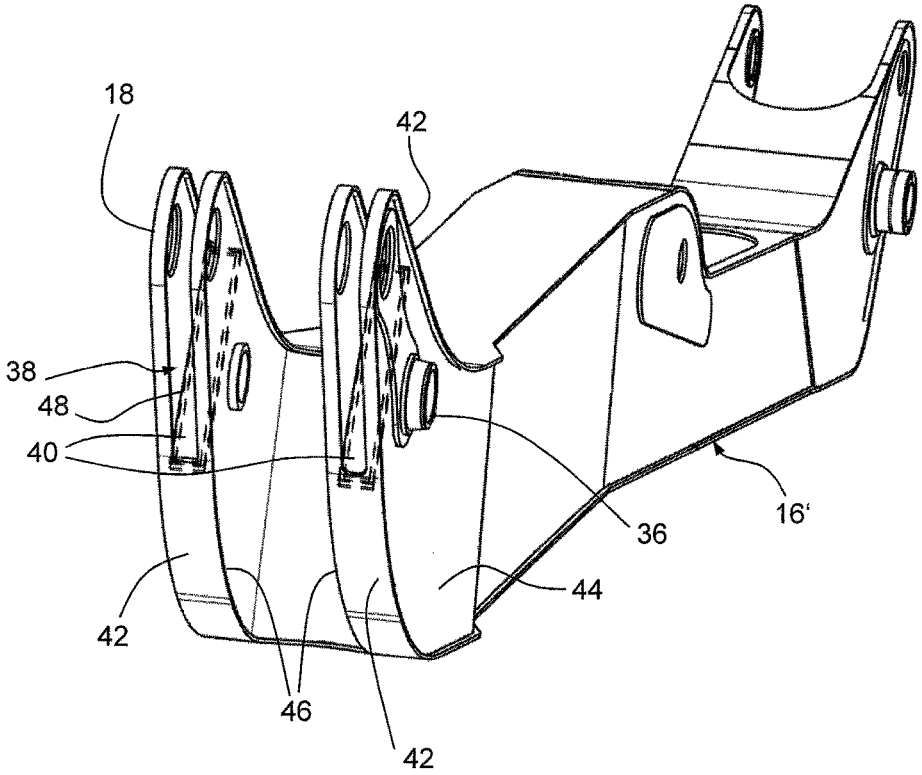
FIG. 3 shows the lower boom arm according to FIG. 2.

As can be seen also from FIG. 3, the boom arms 16 and 16' consist, as an elongated box-like steel construction, at least partially of two chords (more generically, walls) 42 and two webs (more generically, walls) 44, which laterally connect the chords 42. The chords 42 here generally rest on the outside of the longitudinal edges of the webs 44, wherein weld seams extend along those outer margins of the webs 44 which are facing away from the hollow interior, and ensure a continuous sealtight joint. Through the avoidance of chord jumps into the intermediate region between the webs 44, a high rigidity of the box construction is achieved and an adverse notch effect is avoided by transversely running weld seams.

At the forked end of the boom arm 16', the double-webbed members 46, in the region of the hinge joint 18, are recessed on their chords 42, so that the web extensions of the other boom arm 16 can engage there. The recessed regions are shielded inwardly in the direction of the second hinge joint 36 by the rectangular-flat partition walls 40, which, on their peripheral sides (periphery) or outer edges, are provided with a circumferential (peripheral) elastic seal 48.

Figure 4:
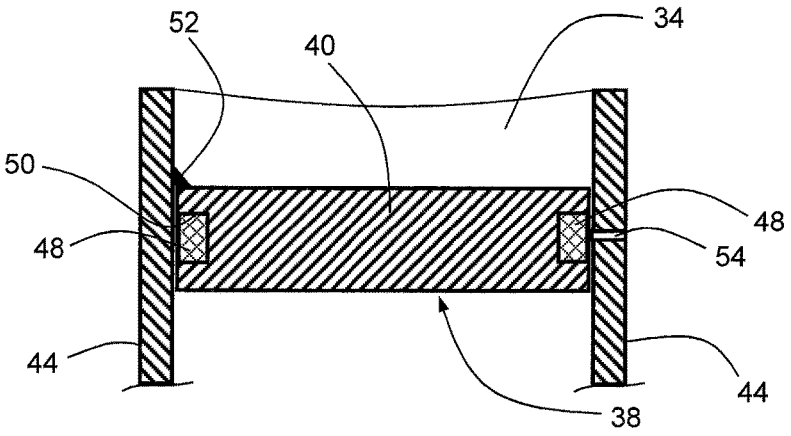
FIG. 4 shows a cross section of the sealing partition arrangement.

FIG. 4 illustrates the sealing partition arrangement 38 in a section transversely to the longitudinal center axis of the, in outline, rectangular partition wall 40. Wall 40 is provided on its periphery or on its four outer edges with a peripheral sealing groove 50, in which the seal 48 is arranged correspondingly peripherally around the partition wall 40. The seal 48 here bears in an elastically sealing manner on the inside against the adjacent side walls (webs 44, and chords 42 not visible in the sectional representation), whereby the opening cross section of the cavity 34 is sealed.

In the production of a boom arm 16, in the course of the welding together of the chords 42 and webs 44, the partition wall 40 pre-fixes a further seal 48 in the cross section to be sealed. This can be realized by spot welding, wherein the weld 52 should preferably lie in the central region close to the neutral axis of the relevant side wall (for example web 44).

Furthermore, the seal 48 is formed by a formless sealing compound, which has been introduced into the sealing groove 50 and may be curable polyurethane sealant. For this purpose, in a side wall (here shown: web 44), a bore 54 is provided as a feed channel for the sealing compound. After the crosslinking, the polyurethane sealant forms a permanently elastic seal 48, which reliably seals the gap between partition wall 40 and side walls 42, 44.

In summary, the following can be stated: This disclosure relates to a boom for a working machine, in particular a concrete distributing boom 14 for guiding a concrete delivery line 22, comprising a plurality of boom arms 16, which are movable into a working position and which are composed at least partially, as a box construction, of a plurality of side walls 42, 44 delimiting a cavity region 34, and further comprising a sealing partition arrangement 38 for sealing a cross section of the cavity region 34, wherein the sealing partition arrangement 38 has a partition wall 40 peripherally provided with an at least partially circumferential sealing groove 50, and that in the sealing groove 50 is arranged an elastic seal 48, which on the inside bears in a sealtight manner against the adjacent side walls 42, 44.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A distributing boom for guiding a delivery line, comprising:

a plurality of boom arms movable into a working position and which are formed at least partially as a box having a plurality of side walls delimiting a cavity; and a sealing partition wall for sealing a cross section of the cavity, the sealing partition wall having an at least partially peripheral sealing groove in which is disposed an elastic seal that sealingly engages the inside of adjacent ones of the side walls.

2. The boom as claimed in claim 1, wherein the elastic seal is formed from a formless sealing compound introduced into the sealing groove.

3. The boom as claimed in claim 2, wherein the elastic seal is formed from a polyurethane sealant.

4. The boom as claimed in claim 1, further comprising a feed channel formed in one of the side walls or the partition wall, the feed channel configured for introducing the sealing compound into the sealing groove.

5. The boom as claimed in claim 1, wherein the partition wall is fixed to at least one of the side walls by an integrally bonded, positive or non-positive connection.

6. The boom as claimed in claim 1, wherein the partition wall joins the adjacent side walls in a central region of the adjacent side walls.

7. The boom as claimed in claim 1, wherein, the partition wall comprises a quadrangular or rectangular metal or plastic plate.

8. The boom as claimed in claim 1, wherein the partition wall comprises a multilayered construction, wherein lateral outer layers of the partition wall define groove flanks of the sealing groove.

9. The boom as claimed in claim 1, wherein the side walls comprise two opposing webs and two chords resting on longitudinal edges of the webs.

10. The boom as claimed in claim 1, wherein the sealing partition wall seals a hinge joint on an end portion of a boom arm against ingress of corrosive media.

11. A method for producing a distributing boom for guiding a delivery line in which a plurality of boom arms are configured to articulately connect to one another, the method comprising:

arranging side walls as a box section of a boom arm that delimits a cavity;

inserting a sealing partition wall into a cross section of the cavity, the sealing partition wall having a peripheral sealing groove;

arranging a seal in the peripheral sealing groove and thereby sealingly engaging the inside of adjacent ones of the side walls.

12. The method as claimed in claim 11, comprising pre-fixing the partition wall in the cross section by using welding, tacking, clamping, screwing, stops or grooves.

13. The method as claimed in claim 11, wherein the step of arranging a seal in the peripheral groove comprises introducing a formless sealing compound into the sealing groove and then curing the sealing compound to form the seal.

14. The method as claimed in claim 13, wherein the formless sealing compound is introduced via a feed channel disposed in one of the side walls or in the partition wall, the feed channel being accessible from outside the boom arm.

* * * * *